United States Patent [19]

Vogel

[11] Patent Number: 4,569,373

[45] Date of Patent: Feb. 11, 1986

[54] TERRYCLOTH WEAVING MACHINE

[75] Inventor: Rudolf Vogel, Grüt, Switzerland

[73] Assignee: Maschinenfabrik Sulzer-Rüti AG, Rüti, Switzerland

[21] Appl. No.: 661,942

[22] Filed: Oct. 17, 1984

[30] Foreign Application Priority Data

Nov. 1, 1983 [EP] European Pat. Off. ..... 83810504.7

[51] Int. Cl.[4] ..... D03D 39/22

[52] U.S. Cl. ..... 139/25; 139/26

[58] Field of Search ..... 139/25, 26, 27, 102

[56] References Cited

U.S. PATENT DOCUMENTS

| | | | |
|---|---|---|---|
| 1,666,872 | 4/1928 | Davis | 139/25 |
| 3,291,158 | 12/1966 | Nichols | 139/25 |
| 3,441,059 | 4/1969 | Götz | 139/25 |
| 3,746,052 | 7/1973 | Burgess | 139/25 |
| 4,403,630 | 9/1983 | Stacher | 139/25 |

*Primary Examiner*—Henry S. Jaudon
*Assistant Examiner*—Steven Shongut
*Attorney, Agent, or Firm*—Werner W. Kleeman

[57] ABSTRACT

The weaving machine includes an electronic control device which can receive a signal for a reverse-motion of the pile warp let-off drive motor from the card dobby via a sensor when borders (plain woven regions) of the fabric are to be produced within the terrycloth material. When the drive motor briefly runs backward, the tension in the pile warp increases, which causes the plate warp tensioning beam to be shifted into the plain weaving position in which a pivoting lever rides up onto a leaf spring. The latter is shifted into the plain weaving position which causes the increased pile warp tension to be produced. If a terrycloth weaving operation is to be returned to, then the drive motor receives an appropriate signal from the card dobby for a brief fast forward motion of the pile warp beam, which causes a lower pile warp tension to be produced again while the pile warp tensioning beam pivots back into the normal position. In this manner particularly regular, loopless borders having sharp or defined edges can be obtained within the terrycloth fabric.

9 Claims, 7 Drawing Figures

Fig.3
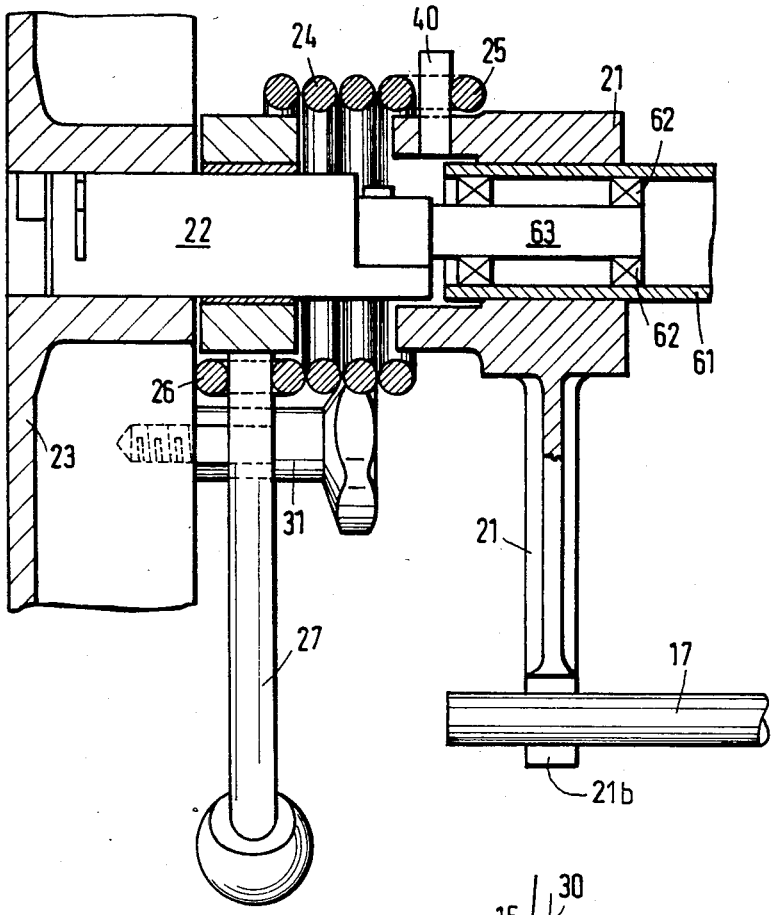
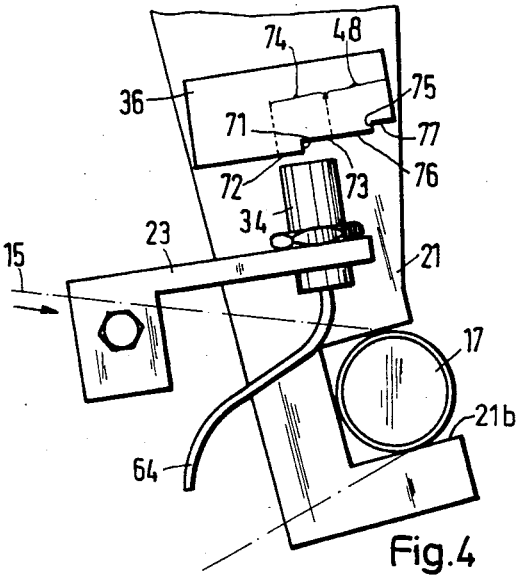
Fig.4
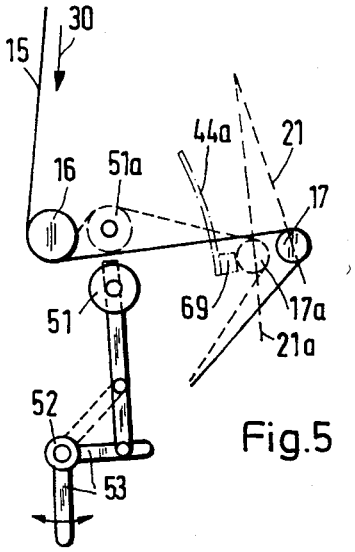
Fig.5

TERRYCLOTH WEAVING MACHINE

BACKGROUND OF THE INVENTION

The present invention broadly relates to weaving machines and, more specifically, pertains to a new and improved construction of a terrycloth weaving machine with a warp let-off regulation device for the pile warp.

In a machine of this type hitherto known from the German Pat. No. 1,294,299, published Apr. 30, 1969, the pile warp let-off regulation device for producing plain loopless fabric regions (e.g. borders) lying within the loop regions is switched to a minimal warp let-off by a signal arriving from the dobby of the weaving machine. It is not possible to suddenly bring the pile warp tension up to a sufficiently high amount required for plain weaving. The pile warp tension cannot be brought up quickly enough from the low tension employed in terrycloth weaving to the high tension required for plain weaving. The borders are therefore not always completely loopless. The edge of the borders can also be irregular at the transition from lower to higher tension and back again.

SUMMARY OF THE INVENTION

Therefore, with the foregoing in mind, it is a primary object of the present invention to provide a new and improved construction of a terrycloth weaving machine which does not exhibit the aforementioned drawbacks and shortcomings of the prior art constructions.

Another and more specific object of the present invention aims at providing a new and improved construction of a terrycloth weaving machine of the previously mentioned type which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the terrycloth weaving machine of the present invention is manifested by the features that it comprises a programmed control device for suddenly or sporadically increasing the pile warp tension for producing plain woven fabric regions, e.g. borders. This makes it possible to obtain completely plain-woven, loopless borders as well as regular edges of the borders with respect to the terrycloth regions.

In other words, the pile warp in the terrycloth weaving machine is subjected to a pile warp tension and a programmed control device suddenly or sporadically increases the pile warp tension in a predetermined manner for producing plain woven fabric regions.

In one embodiment the programmed control device includes an electric pile warp let-off drive motor switchable to reverse-motion. The increase of tension for plain weaving can then be achieved in particularly simple manner if the tension elements, e.g. springs, producing the pile warp tension are appropriately designed.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIGS. 3 and 4 schematically show associated details on a further enlarged scale; and FIGS. 5 through 7 schematically show details of modified embodiments of the invention.

DETAILED DESCRIPTION OF THE PREFERRED EMBODIMENTS

Figure 1:
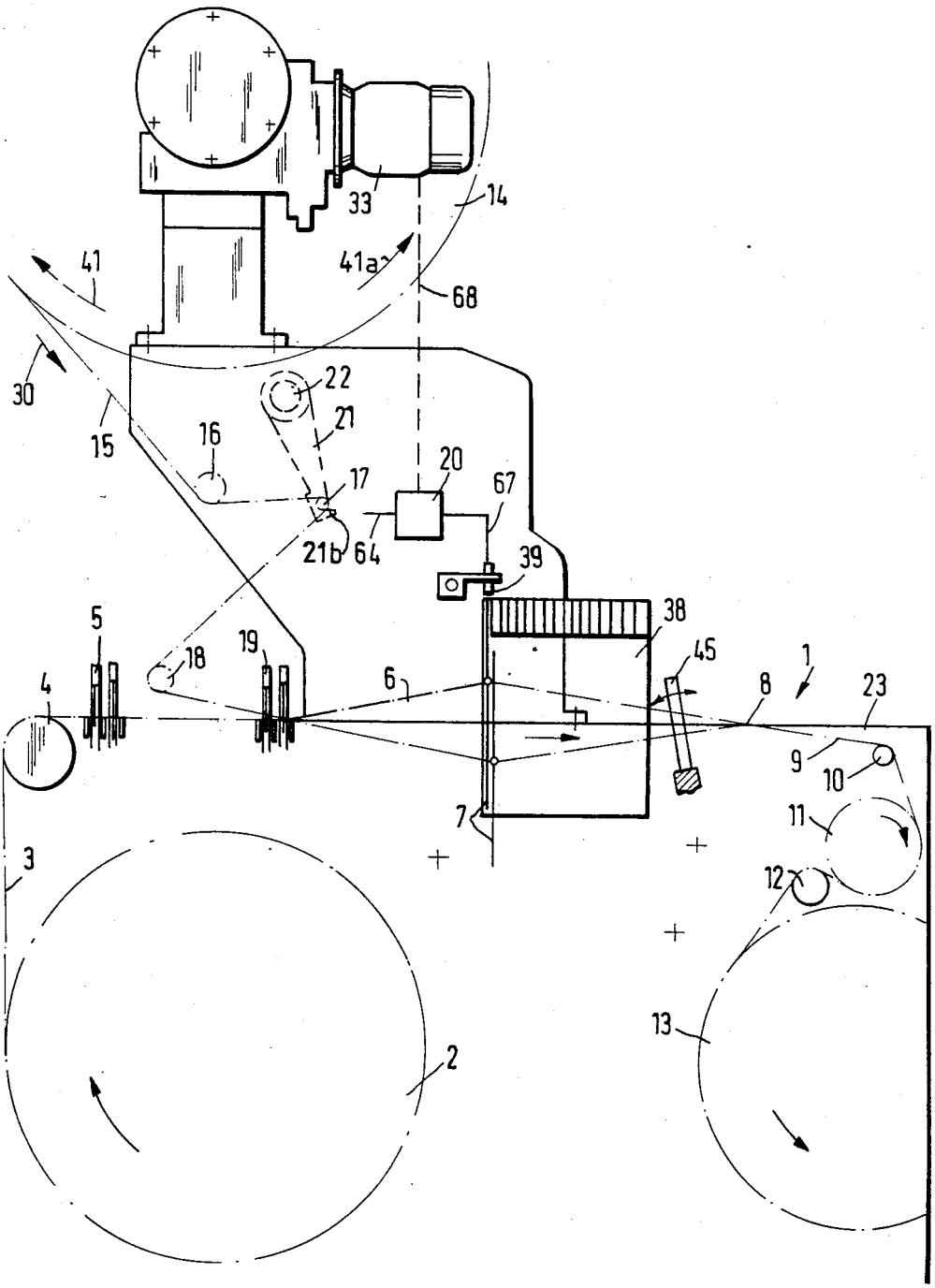
FIG. 1 schematically shows a terrycloth weaving machine constructed according to the invention and partially depicted in section.

Describing now the drawings, it is to be understood that to simplify the showing thereof only enough of the structure of the exemplary embodiments of terrycloth weaving machines has been illustrated therein as is needed to enabe one skilled in the art to readily understand the underlying principles and concepts of this invention. Turning now specifically to FIG. 1 of the drawings, the apparatus illustrated therein by way of example and not limitation will be seen to comprise a terrycloth weaving machine generally designated in its entirety with the reference numeral 1 and including a ground warp beam 2 from which the warp 3 is guided over a ground warp tensioning beam or back rest roller 4 and a warp thread or ground warp stop motion 5 to a weaving shed 6. The latter is formed by heddles 7, only two of which are speciafically represented in FIG. 1. The fabric beating-up edge or fell is situated at the position designated by the reference numeral 8. The fabric or cloth 9 is wound over a deflecting roller 10, a cloth take-off roller 11 and a further deflecting roller 12 up on a cloth roller or breast beam 13.

The pile warp 15 is wound-off a pile warp beam 14 under relatively low tension and guided over a stationarily arranged rotatable deflecting roller 16, a pile warp tensioning beam 17, a stationarily arranged rotatable deflecting roller 18 and a pile warp stop motion 19 to the weaving shed 6. The pile warp 15 runs hence together with the ground warp 3 to the right as seen in FIG. 1.

Figure 2:
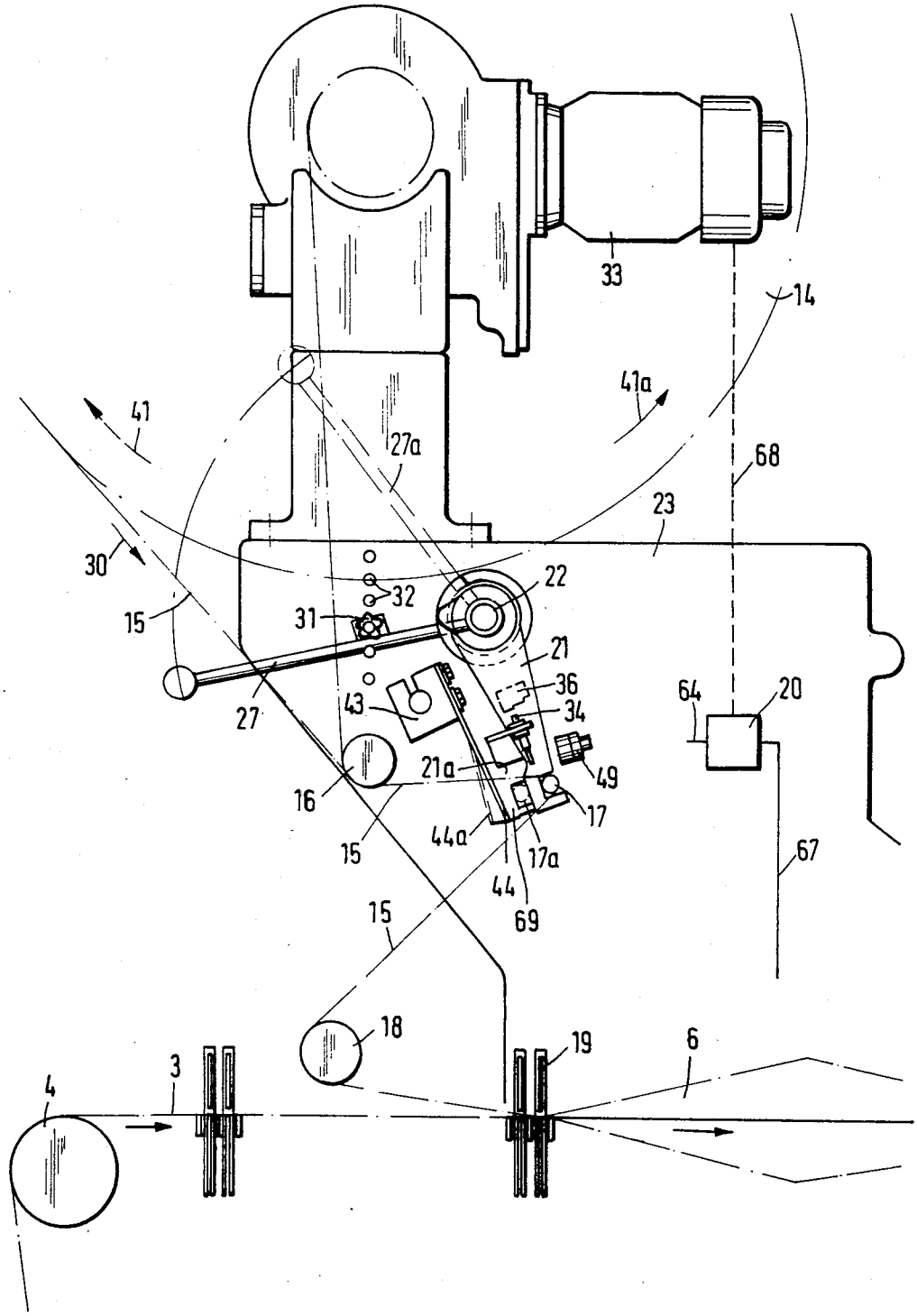
FIG. 2 schematically shows an associated detail view on an enlarged scale of part of the arrangement depicted in FIG. 1 and again partially in section.

The pile warp tensioning beam 17 is mounted in U-shaped ends 21*b* of pivot arms 21, only one of which is visible in FIGS. 2 and 3. Each pivot arm 21 is fastened upon a support tube 61 which is rotatably journalled in ball bearings 62 upon a shaft stub 63 mounted on a shaft 22. Thus each pivot arm 21 is pivotable about the shaft 22 which is arranged in a machine frame 23. Each pivot arm 21 is furthermore subject to the action of a spiral spring 24 or equivalent biasing element whose one hook-shaped end 25 is connected with the pivot arm 21 via a pin 40 connected with this pivot arm 21 and whose other end 26 is connected with a hand lever 27 pivotable about the shaft 22. A stationary stop for the pivot arm 21 is designated with the reference numeral 49.

During normal terrycloth weaving operation, the pile warp 15 is adjusted to a suitable, relatively low tension by inserting a stop or limit screw 31 into one of a plurality of holes 32 fashioned in the frame 23 of the weaving machine. For this purpose, the hand lever 27 is conducted out of the position 27*a* represented in phantom lines in FIG. 2 and into the operative position 27 represented in full lines and in which the pile warp tensioning beam 17 is in the reduced pile warp tensioning position represented in solid lines in FIG. 2.

Pile warp let-off (arrow 41*a* of FIG. 1) is feedback-regulated during terrycloth weaving operation in that an electric warp let-off regulating drive motor 33 receives signals via a conductor or line 64 and an electronic programmed control device 20 from a sensor 34 stationarily mounted upon the machine frame 23 for the desired faster or slower let-off of the pile warp 15. If the pile warp tensioning beam 17, for instance, shifts slightly to the right as seen in FIG. 4, then primarily a region 74 including surfaces 72 and 73 separated by a step or shoulder 71 of a control block 36 fastened upon the pivot arm 21 enters into operative relationship with the sensor 34. An appropriate signal for reduced warp let-off is transmitted to the warp let-off motor 33 from the sensor 34.

If, on the contrary, the pile warp tensioning beam 17 shifts slightly to the left as seen in FIG. 4, then primarily a neighboring region 48 is shifted in front of the sensor 34 so that a signal for more rapid pile warp let-off is transmitted to the drive motor 33 from the sensor 34.

If a plain woven region, e.g. a border, is to be woven, then a signal is transmitted from a card dobby 38 driving the heddles 7 via a stationarily mounted sensor 39, a conductor or line 67, the control device 20 and a conductor or line 68 to the electric motor 33 for switching or reversing the rotational direction of this motor (reverse-motion). The pile warp beam 14 is thereby briefly rotated according to the broken-line arrow 41 (cf. FIGS. 1 and 2), which causes the pivot arm 21 to be pivoted in clockwise direction as seen in FIGS. 1 and 2. The pivot arm 21 therefore shifts out of the terrycloth weaving position 21 represented in full lines in FIG. 2 and into the position 21*a* represented in broken lines and in which the pivot arm 21 rides up onto or comes into contact with a leaf or contact spring 44 carrying a block 69 and stationarily fastened to the machine frame 23 at the location indicated by reference numeral 43. The pivot arm 21 forces the leaf spring 44 into a plain weaving position 44*a* represented in broken lines in FIG. 2. The previously described operations cause the tension in the pile warp 15 to be sporadically or suddenly increased (e.g. within one second) from, for instance, 10 grams per pile warp thread (pile weaving operation) to, for instance, 40 grams per pile warp thread (plain weaving operation).

Weaving is then continued in plain weaving operation or mode under the increased tension increase in the pile warp 15. The weaving reed 45 performs only full beating-up motions. No further terrycloth loops arise in the fabric. During this plain weaving operation the drive motor 33 is running again in forward direction after the brief reverse-motion and the sudden tension increase in the pile warp 15, so that the pile warp beam 14 rotates according to the arrow 41*a* of FIG. 1.

Warp let-off feedback regulation during plain weaving takes place in an analogous manner to that during terrycloth weaving, by means of the region 48 of the control block 36, which is now shifted in front of the sensor 34. The region 48 includes both surfaces 76 and 77 separated by the step or shoulder 75.

If operation is to be switched back again from plain weaving to terrycloth weaving, then the drive motor 33 receives a signal from the card dobby 38 via the sensor 39 and the control device 20 for brief fast forward motion, thus causing the pile warp beam 14 to briefly rotate forwardly in fast motion in the direction of the arrow 41*a*. This causes the tension in the pile warp 15 to again be decreased. The pivot lever 21 and the pile warp tensioning beam 17 are shifted into the terrycloth weaving position represented in full lines in FIG. 2. Normal terrycloth weaving operation, entailing the weaving of loops, continues once the region 74 is again shifted in front of the sensor 34.

In the embodiment according to FIG. 5, a roller 51 insertable into the path of the pile warp 15 and producing additional path length for such pile warp is provided for briefly and suddenly increasing the tension in the pile warp 15. The roller 51 can be shifted into the upper plain weaving position 51*a* represented in broken lines in FIG. 5 for increasing the pile warp tension. A control lever 53 pivotable about the pivot point or location 52 and actuated by a signal from the card dobby 38 is provided for this purpose.

Figure 6:
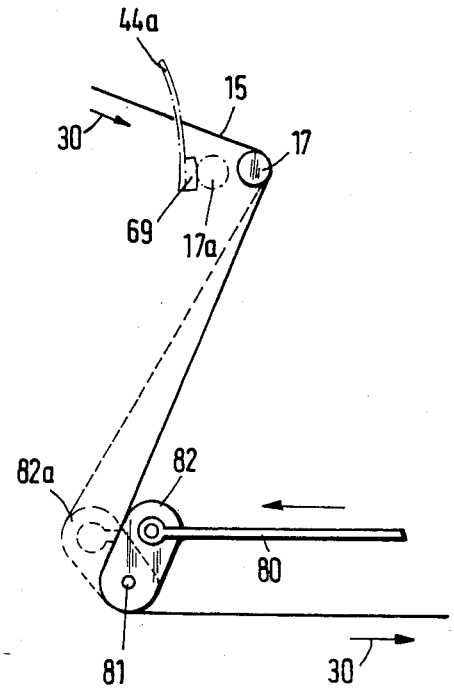

In the embodiment according to FIG. 6 a pivoting profile or edge 82 pivotable about a pivot point or location 81 by means of a control rod 80 and extending over the entire weaving width is provided in place of the deflecting roller 18 according to FIG. 2. The sudden increase of the pile warp tension can also be achieved by this pivoting profile 82 if such profile is pivoted out of the terrycloth weaving position 82 into the plain weaving position 82*a*.

The signals for plain weaving transmitted by the card dobby 38 containing the weaving program can be transmitted according to a fabric weaving program or also according to a program temporarily input into the control device 20 so that, for instance, five minutes of terrycloth weaving is followed by one minute of plain weaving and so forth.

In a further embodiment the leaf spring 44 is omitted and the spring 24 is subdivided into two stages with respect to its spring action. The first stage has a flat spring characteristic suited to terrycloth weaving and the second stage has an increasing or steeper spring characteristic producing the increased pile warp tension required for plain weaving.

The signal arriving from the card dobby 38 for increasing the tension of the pile warp 15 can also be employed directly for further rotation and thereby increased pre-tensioning of the spring 24 for the purpose of plain weaving.

Figure 7:
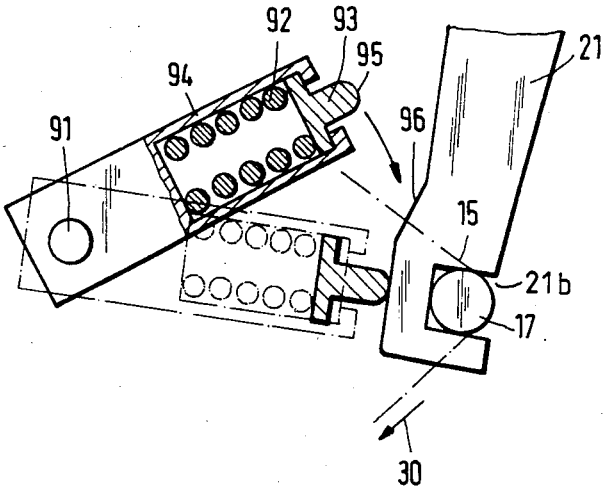

In the construction shown in FIG. 7 a pivoting cylinder 94 is provided which is pivotable about the pivot location indicated by reference numeral 91 and contains a piston 93 subject to the action of a compression spring 92. The pivoting cylinder 94 can be pivoted into the plain weaving position represented in broken lines in FIG. 7 by the signal for increasing the pile warp tension transmitted by the card dobby 38 and in which position the head 95 of the piston 93 rides up on or comes into contact with a ramp or curved or camming surface 96 mounted on the arm or lever 21. Now tension of the pile warp 15 increased by the spring 92 is produced without the pile warp 15 having to be drawn back and also without the lever 21 having to be pivoted.

While there are shown and described present preferred embodiments of the invention, it is to be distinctly understood that the invention is not limited thereto, but may be otherwise variously embodied and practiced within the scope of the following claims.

ACCORDINGLY, What I claim is:

1. A terrycloth weaving machine, comprising:

a warp let-off regulation device for regulating a pile warp tension of a pile warp material;

control means for altering said pile warp tension and for altering a pile warp let-off speed of said pile warp material;

a pivotably arranged pile warp tensioning beam;

retraction means for effecting a rapid increase of said pile warp tension by performing a rapid retraction of said pile warp material in relation to said pile warp tensioning beam;

said pile warp tensioning beam being arranged to perform a pivoting motion when subjected to said rapid increase of pile warp tension; and speed reduction means cooperating with said control means for incrementally reducing a first value of said pile warp let-off speed prevailing before said rapid retraction to a second value of said pile warp let-off speed prevailing subsequent to said rapid retraction.

2. The weaving machine as defined in claim 1, further including:

means for controlling said speed reduction means;

said pivoting motion causing a positional change of said pile warp tensioning beam; and said means for controlling said speed reduction means operating independently of said positional change.

3. The weaving machine as defined in claim 2, wherein:

said pile warp tensioning beam has a momentary position; and said speed reduction means comprising:

a stationary sensor;

a movable control block operatively associated with said stationary sensor;

said movable control block being operatively associated with said pile warp tensioning beam to perform said pivoting motion conjointly therewith;

said movable control block having a plurality of effective regions dependent upon said momentary position of said pile warp tensioning beam;

a pile warp let-off drive motor; and a control device for transmitting to said pile warp let-off drive motor a respective predetermined signal for each effective region of said plurality of effective regions when each said effective region confronts said stationary sensor.

4. The weaving machine as defined in claim 1, further including:

a shed-forming device;

a pile warp let-off drive motor;

said pile warp let-off drive motor having a reverse running direction;

said retraction means comprising a control device for briefly reversing said pile warp let-off drive motor to said reverse running direction; and said control device being controlled by said shed-forming device.

5. The weaving machine as defined in claim 1, wherein:

said pile warp material has a predetermined path of travel; and said retraction means comprising a substantially bar-shaped element pivotable under program control into said path of travel for generating an increase in length of said path of travel.

6. The weaving machine as defined in claim 1, further including:

a spiral spring for biasing said pile warp tensioning beam;

a hand lever for biasing said spiral spring;

a limit stop defining incremental positions of said hand lever;

said pile warp tensioning beam, said spiral spring and said limit stop conjointly defining pile warp tensioning means for exerting a tensioning effect upon said pile warp material;

supplementary tensioning means for increasing said pile warp tension during said pivoting motion of said pile warp tensioning beam; and said supplementary tensioning means tensioning the pile warp material supplementarily to said tensioning effect of said pile warp tensioning means.

7. The weaving machine as defined in claim 6, wherein:

said supplementary tensioning means comprises contact spring means for said pile warp tensioning beam;

said pile warp tensioning beam defining a pivoting region thereof; and said contact spring means being arranged within said pivoting region such that said pile warp tensioning beam contacts said contact spring means during said rapid retraction of said pile warp material.

8. The weaving machine as defined in claim 6, further including:

a pivotable cylinder containing both a piston member and a compression spring acting upon said piston member;

said pile warp tensioning beam defining a pivoting region thereof; and said pivotable cylinder being rotatably arranged within said pivoting region.

9. A terrycloth weaving machine, comprising:

a warp let-off regulation device for regulating a pile warp tension of a pile warp material;

control means for altering said pile warp tension and for altering a pile warp let-off speed of said pile warp material;

a pivotably arranged pile warp tensioning beam;

a pivotable cylinder containing a piston member and a compression spring acting upon said piston member;

said pile warp tensiong beam being arranged to perform a pivoting motion and defining a pivoting region thereof;

said pivotable cylinder being rotatably arranged within said pivoting region;

speed altering means cooperating with said control means for incrementally alternating said pile warp let-off speed between a value for terrycloth weaving and a value for plain weaving; and said pivotable cylinder operatively engaging said pile warp tensioning beam when said plain weaving value of said pile warp let-off speed prevails.

* * * * *